US008570247B2

(12) United States Patent
Kim et al.

(10) Patent No.: US 8,570,247 B2
(45) Date of Patent: Oct. 29, 2013

(54) PLASMA DISPLAY DEVICE, AND APPARATUS AND METHOD FOR DRIVING THE SAME

(75) Inventors: Suk-Ki Kim, Gyeonggi-do (KR); Ji-Hyun Yoo, Gyeonggi-do (KR); Seong-Joong Kim, Gyeonggi-do (KR)

(73) Assignee: Samsung SDI Co., Ltd., Yongin-si, Gyeonggi-do (KR)

( * ) Notice: Subject to any disclaimer, the term of this patent is extended or adjusted under 35 U.S.C. 154(b) by 1140 days.

(21) Appl. No.: 12/503,744

(22) Filed: Jul. 15, 2009

(65) Prior Publication Data

US 2010/0013744 A1 Jan. 21, 2010

(30) Foreign Application Priority Data

Jul. 15, 2008 (KR) ..... 10-2008-0068651

(51) Int. Cl.
*G09G 3/28* (2013.01)

(52) U.S. Cl.
USPC ..... 345/63; 345/60; 315/169.4

(58) Field of Classification Search
USPC ..... 345/60–69, 691–693, 211, 204
See application file for complete search history.

(56) References Cited

U.S. PATENT DOCUMENTS

| | | | | |
|---|---|---|---|---|
| 7,242,372 | B2 | 7/2007 | Onozawa et al. | |
| 7,471,264 | B2 * | 12/2008 | Inoue et al. | 345/60 |
| 7,667,696 | B2 * | 2/2010 | Jang et al. | 345/60 |
| 7,852,291 | B2 * | 12/2010 | Lim | 345/60 |
| 7,915,832 | B2 * | 3/2011 | Arai et al. | 315/169.4 |
| 2007/0268216 | A1 | 11/2007 | Arai et al. | |

FOREIGN PATENT DOCUMENTS

| | | | |
|---|---|---|---|
| CN | 1674070 | A | 9/2005 |
| CN | 1928956 | A | 3/2007 |
| EP | 1 684 261 | A2 | 7/2006 |
| KR | 10-2003-0013029 | | 2/2003 |
| KR | 10-2003-0034763 | | 5/2003 |
| KR | 10-2005-0000110 | | 1/2005 |
| KR | 10-2007-0087717 | | 8/2007 |
| KR | 10-2007-0105741 | | 10/2007 |

OTHER PUBLICATIONS

European Search Report dated Oct. 14, 2011 for European Patent Application No. EP 09 165 027.5 which shares priority of Korean Patent Application No. KR 10-2008-0068651 with captioned U.S. Appl. No. 12/503,744.

Chinese Office Action dated Mar. 17, 2011 for Chinese Patent Application No. CN200910139950.1 corresponding to Korean Patent Application No. KR 10-2008-0068651 which corresponds to the captioned application.

SIPO Letters Patent dated Jul. 18, 2012 for Chinese Patent Application No. ZL 200910139950.1 which shares priority of Korean Patent Application No. KR 10-2008-0068651 with captioned U.S. Appl. No. 12/503,744.

* cited by examiner

*Primary Examiner* — Duc Dinh
(74) *Attorney, Agent, or Firm* — Knobbe, Martens, Olson & Bear LLP

(57) ABSTRACT

A plasma display device and method of driving the device is disclosed. The device includes a driving circuit for driving reset, address, and sustain periods during a subfield of a frame. The driving circuit includes a single switch which is used to drive a display electrode both during the reset period and during the sustain period. The switch being used for both periods removes the need for a second switch, thereby reducing manufacturing and design costs.

20 Claims, 9 Drawing Sheets

PLASMA DISPLAY DEVICE, AND APPARATUS AND METHOD FOR DRIVING THE SAME

CROSS-REFERENCE TO RELATED APPLICATION

This application claims priority to and the benefit of Korean Patent Application No. 10-2008-0068651 filed in the Korean Intellectual Property Office on Jul. 15, 2008, the entire contents of which are incorporated herein by reference.

BACKGROUND

1. Field

The field relates to a plasma display device, and an apparatus and a method for driving the same.

2. Description of the Related Technology

A plasma display device is a flat panel display that uses plasma generated by gas discharge to display characters or images. A display panel of the plasma display device includes a plurality of discharge cells (hereinafter, simply called cells) arranged in a matrix pattern.

The plasma display device is driven by dividing one frame into a plurality of subfields each subfield having a luminance weight. In this case, luminance of a cell for a frame is determined by the sum of the luminance weights of subfields for the frame.

In addition, each subfield includes a reset period, an address period, and a sustain period. The reset period is used for initializing a wall charge state of each discharge cell, and the address period is used for performing an addressing operation so as to select on-cells or off-cells. The sustain period is used for displaying an image by sustain-discharging the on-cells selected in the address period for a duration that corresponds to the luminance weight of the corresponding subfield.

In the reset period, the wall charge state is initialized through a weak discharge induced by applying a gradually decreasing voltage waveform to a scan electrode after applying a gradually increasing voltage waveform (hereinafter called a reset rising waveform) to the scan electrode. During the sustain period, the sustain discharge is induced at the on-cells by applying a sustain pulse with opposite phases to a scan electrode and a sustain electrode.

In a typical plasma display device, a circuit for applying the reset rising waveform to the scan electrode and a circuit for applying the sustain pulse to the scan electrode are separately arranged.

That is, a voltage (hereinafter called a reset rising voltage) used for the reset rising waveform and a voltage (hereinafter called a sustain voltage) used for the sustain pulse are different voltage levels, and a power source for supplying the reset rising voltage and a power source for supplying the sustain voltage are separately arranged. Further, a switch for applying the reset rising voltage to the scan electrode and a switch for applying the sustain voltage to the scan electrode are separately arranged. Since the reset rising voltage and the sustain voltage are high voltages, high cost switches having high maximum tolerance voltages are used for these switches.

According to such a scheme, because the reset rising voltage and the sustain voltage are different voltage levels, a separate element is used so as to prevent a current path from being formed toward the power source for supplying the reset rising voltage or the power source for supplying the sustain voltage. Accordingly, there is disadvantageous circuit complexity.

The above information disclosed in this Background section is only for enhancement of understanding of the background of the invention and therefore it may contain information that does not form the prior art that is already known in this country to a person of ordinary skill in the art.

SUMMARY OF THE INVENTION

One aspect is a plasma display device including a display electrode, and a first switch that includes a first terminal coupled to a node, a second terminal coupled to a power source supplying a first voltage, and a control terminal, the node being coupled to the display electrode. The device also includes a first gate driver that includes an output terminal, the first gate driver configured to output a first control signal having a first level to the control terminal of the first switch through the output terminal of the first gate driver, the first switch configured to gradually increase a voltage of the display electrode from a second voltage to a third voltage in response to the first control signal having the first level. The device also includes a second gate driver that includes an output terminal, the second gate driver configured to output a second control signal having the first level to the control terminal of the first switch through output terminal of the second gate driver. The first switch is configured to transmit the first voltage from the power source to the display electrode in response to the second control signal having the first level. The device also includes a switch turn-off unit configured to turn off the first switch in response to the first control signal having a second level and the second control signal having the second level, the second level being different from the first level.

Another aspect is a method of driving a plasma display device including a display electrode and a switch coupled between the display electrode and a power source supplying a first voltage. The method includes dividing a subfield into at least a reset period, an address period, and a sustain period, outputting a first control signal having a first level and a second control signal having a second level being different from the first level in a portion of the reset period, operating the switch to gradually increase a voltage of the display electrode from a second voltage to a third voltage in response to the first control signal having the first level, outputting the first control signal having the second level and the second control signal having the second level in the address period, turning off the switch in response to the first control signal having the second level and the second control signal having the second level, outputting the first control signal having the second level and the second control signal having the first level in a portion of the sustain period, and operating the switch to transmit the first voltage from the power source to the display electrode in response to the second control signal having the first level.

Another aspect is an apparatus for driving a plasma display device including a display electrode. The apparatus includes a switch coupled between the display electrode and a power source configured to supply a first voltage, a first gate driver that outputs a first control signal alternately having a first level and a second level, a second gate driver that outputs a second control signal alternately having the first level and the second level, a switch turn-off unit that turns off the switch in response to the first control signal having the second level and the second control signal having the second level, where the switch is configured to gradually increase a voltage of the display electrode from a second voltage to a third voltage in response to the first control signal having the first level, and the switch is configured to transmit the first voltage from the power source to the display electrode in response to the second control signal having the first level.

DETAILED DESCRIPTION OF CERTAIN INVENTIVE EMBODIMENTS

Figure 1:
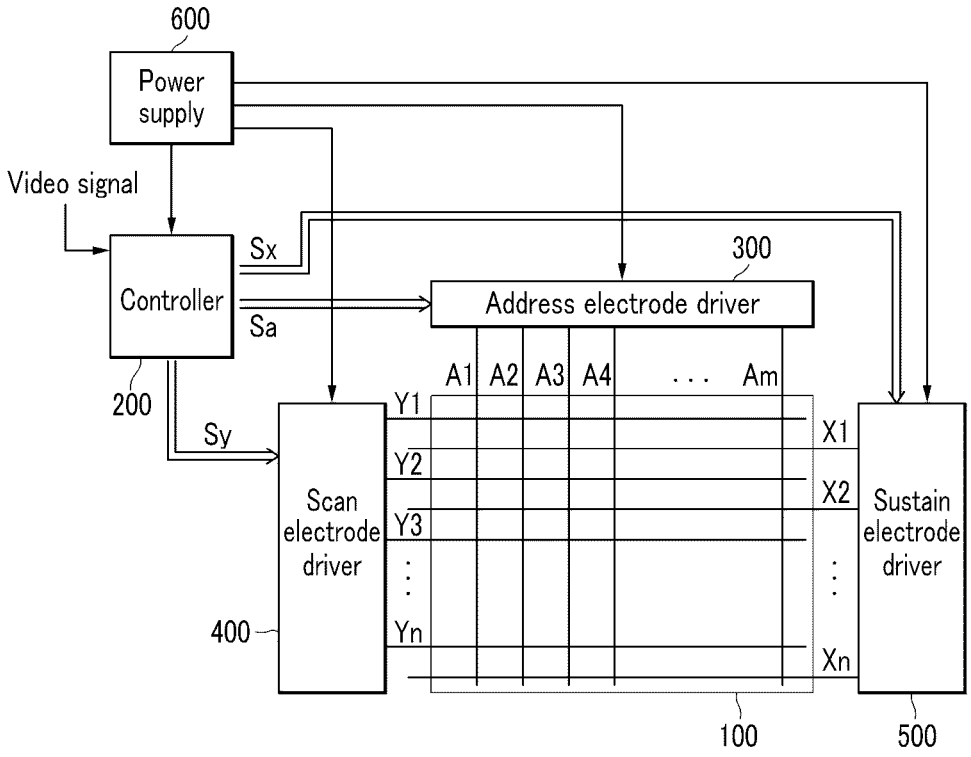
FIG. 1 is a block diagram of a plasma display device according to an embodiment.

In the following detailed description, only certain embodiments have been shown and described, simply by way of illustration. As those skilled in the art would realize, the described embodiments may be modified in various ways, without departing from the spirit or scope of the present invention. Accordingly, the drawings and description are to be regarded as illustrative in nature and not restrictive. Like reference numerals generally designate like elements throughout the specification.

Throughout this specification and the claims that follow, when it is described that an element is "coupled" to another element, the element may be "directly coupled" to the other element or "indirectly coupled" to the other element through a third element.

The wall charges described in the present specification are charges formed on a wall (e.g., a dielectric layer) close to each electrode of a discharge cell. The wall charges will be described as being "formed" or "accumulated" on the electrode, although the wall charges may not actually touch the electrodes. A wall voltage is a potential difference formed on the wall of the discharge cell by the wall charges.

When it is described in the specification that a voltage is maintained, it should not be understood to strictly imply that the voltage is maintained precisely at a voltage value. To the contrary, even if a voltage difference between two points varies, the voltage difference is expressed to be maintained at the voltage value if the variance is within a range allowed in design constraints or in the case that the variance is caused due to a parasitic component that may be disregarded by a person of ordinary skill in the art. In addition, since threshold voltages of semiconductor elements (e.g., a transistor and a diode) are very low compared to a discharge voltage, they are generally considered to be 0V.

FIG. 1 is a block diagram of a plasma display device according to an embodiment.

Referring to FIG. 1, a plasma display device includes a plasma display panel (PDP) 100, a controller 200, an address electrode driver 300, a scan electrode driver 400, a sustain electrode driver 500, and a power supply 600.

The PDP 100 includes a plurality of display electrodes Y1 to Yn and X1 to Xn, a plurality of address electrodes A1 to Am, and a plurality of cells. The plurality of display electrodes Y1 to Yn and X1 to Xn includes a plurality of scan electrodes Y1 to Yn and a plurality of sustain electrodes X1 to Xn. The scan electrodes Y1 to Yn and the sustain electrodes X1 to Xn extend substantially in a row direction, and are substantially parallel to each other. The address electrodes A1 to Am extend substantially in a column direction crossing the row direction and are substantially parallel to each other. Each of the scan electrodes Y1 to Yn may correspond to one of the sustain electrodes X1 to Xn, or one of the scan electrodes Y1 to Yn may correspond to two of the sustain electrodes X1 to Xn. The discharge spaces formed near crossing regions of the address electrodes A1-Am and the sustain and scan electrodes X1-Xn and Y1-Yn form cells. The above-described PDP 100 is only one example, and a PDP having other structures may be applied to an embodiment.

The controller 200 receives a video signal and an input control signal for controlling the display of the video signal. The video signal includes luminance information of each of the cells for each frame, and the luminance of each of the cells may be represented as one of a number of gray levels. The controller 200 divides each frame for displaying an image into a plurality of subfields, where each subfield has a luminance weight, and includes a reset period, an address period, and a sustain period. The controller 200 processes the video signal and the input control signal based on the plurality of subfields, and generates an address electrode driving control signal Sa, a scan electrode driving control signal Sy, and a sustain electrode driving control signal Sx. The controller 200 outputs the address electrode driving control signal Sa to the address electrode driver 300, the scan electrode driving control signal Sy to the scan electrode driver 400, and the sustain electrode driving control signal Sx to the sustain electrode driver 500.

The address electrode driver 300 receives the address electrode driving control signal Sa from the controller 200 and applies a voltage to each address electrode so as to select on-cells and off-cells.

The scan electrode driver 400 receives the scan electrode driving control signal Sy from the controller 200 and applies a driving voltage to the scan electrodes Y1-Yn.

The sustain electrode driver 500 receives the sustain electrode driving control signal Sx from the controller 200 and applies a driving voltage to the sustain electrodes X1-Xn.

The power supply 600 supplies power for driving the plasma display device to the controller 200 and the address, scan, and sustain electrode drivers 300, 400, and 500.

Hereinafter, a driving waveform of a plasma display device according to one embodiment will be described with reference FIG. 2.

Figure 2:
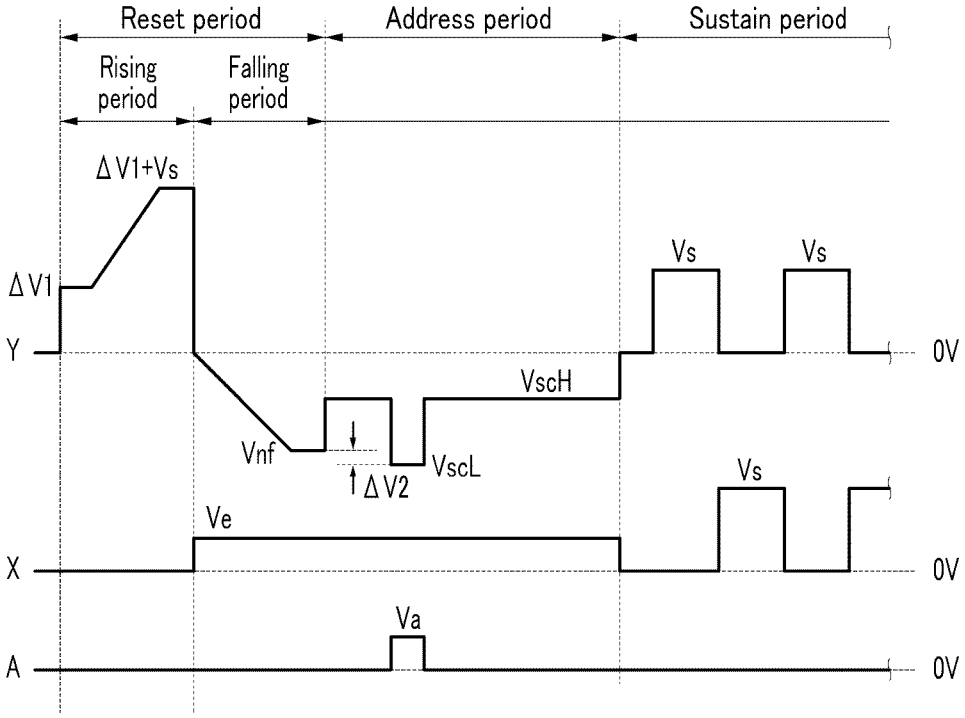
FIG. 2 shows a driving waveform of a plasma display device according to an embodiment.

FIG. 2 shows a driving waveform of a plasma display device according to an embodiment.

For convenience of description and better understanding, FIG. 2 only shows a single subfield of a plurality of subfields, and the following description is focused on a driving waveform applied to the scan electrode Y, the sustain electrode X, and the address electrode A of a single cell.

The reset period will now be described. The reset period includes a rising period and a falling period.

During the rising period, a voltage of the scan electrode Y is gradually increased from a voltage of ΔV1 to a voltage of (ΔV1+Vs) while the address electrode A and the sustain electrode X are maintained at a reference voltage (e.g., 0V in FIG.

2, and hereinafter the exemplary reference voltage is 0V). In this case, a weak discharge is generated between the scan electrode Y and the sustain electrode X and between the scan electrode Y and the address electrode A so that negative wall charges are formed on the scan electrode Y and positive wall charges are formed on the sustain electrode X and the address electrode A. In order to reset all cells during the reset period, the voltage (ΔV1+Vs) may be set to a voltage that is high enough to cause a discharge in all the cells, regardless of their wall charge state.

During the falling period, the voltage of the scan electrode Y is gradually decreased from the reference voltage to a voltage Vnf while the address electrode A and the sustain electrode X are maintained at the reference voltage and a voltage Ve, respectively. In this case, a weak discharge is generated between the scan electrode Y and the sustain electrode X and between the scan electrode Y and the address electrode A so that the negative wall charges formed on the scan electrode Y and the positive wall charges formed on the sustain electrode X and the address electrode A during the rising period are canceled. A voltage (Vnf−Ve) may be set close to a discharge firing voltage between the scan electrode Y and the sustain electrode X, and accordingly, a wall voltage between the scan electrode Y and the sustain electrode X becomes close to 0V so that the cell that does not experienced an address discharge during the address period can be prevented from experiencing a misfiring.

During the address period, a scan pulse having a voltage of VscL (i.e., the scan voltage) is sequentially applied to the plurality of scan electrodes Y1 to Yn while the sustain electrode X is applied with a voltage of Ve so as to select on-cells. In addition, an address voltage is applied to an address electrode A of a cell, which will be set to an on-cell, of a plurality of cells of the scan electrode Y to which the voltage of VscL is applied. Then, an address discharge is generated between the address electrode A to which the address voltage Va is applied and the scan electrode Y to which the voltage VscL is applied and between the scan electrode Y to which the voltage of VscL is applied and a sustain electrode X that corresponds to the scan electrode Y to which the voltage of VscL is applied. Accordingly, positive wall charges are formed on the scan electrode Y and negative wall charges are formed on the address electrode A and the sustain electrode X, respectively. In this case, the voltage of VscL may be set to be equal to the voltage of Vnf or lower than that by a voltage ΔV2. Meanwhile, scan electrodes to which the voltage VscL are not applied are applied with a voltage of VscH (i.e., a non-scan voltage) that is higher than the voltage of VscL, and an address electrode A of an unselected cell is applied with the reference voltage.

During the sustain period, a sustain pulse having a high level voltage (Vs in FIG. 2) and a low level voltage (0V in FIG. 2) is alternately applied in opposite phases to the scan electrode Y and the sustain electrode X. Thus, 0V is applied to the sustain electrode X when the voltage of Vs is applied to the scan electrode Y, and 0V is applied to the scan electrode Y when the voltage of Vs is applied to the sustain electrode X. A sustain-discharge is generated in the scan electrode Y and the sustain electrode X by a wall voltage formed between the scan electrode Y and the sustain electrode X due to the address discharge and the voltage Vs. Then, an operation for applying the sustain pulse to the scan electrode Y and the sustain electrode X is repeated a number of times corresponding to a luminance weight of the corresponding subfield.

Figure 3:
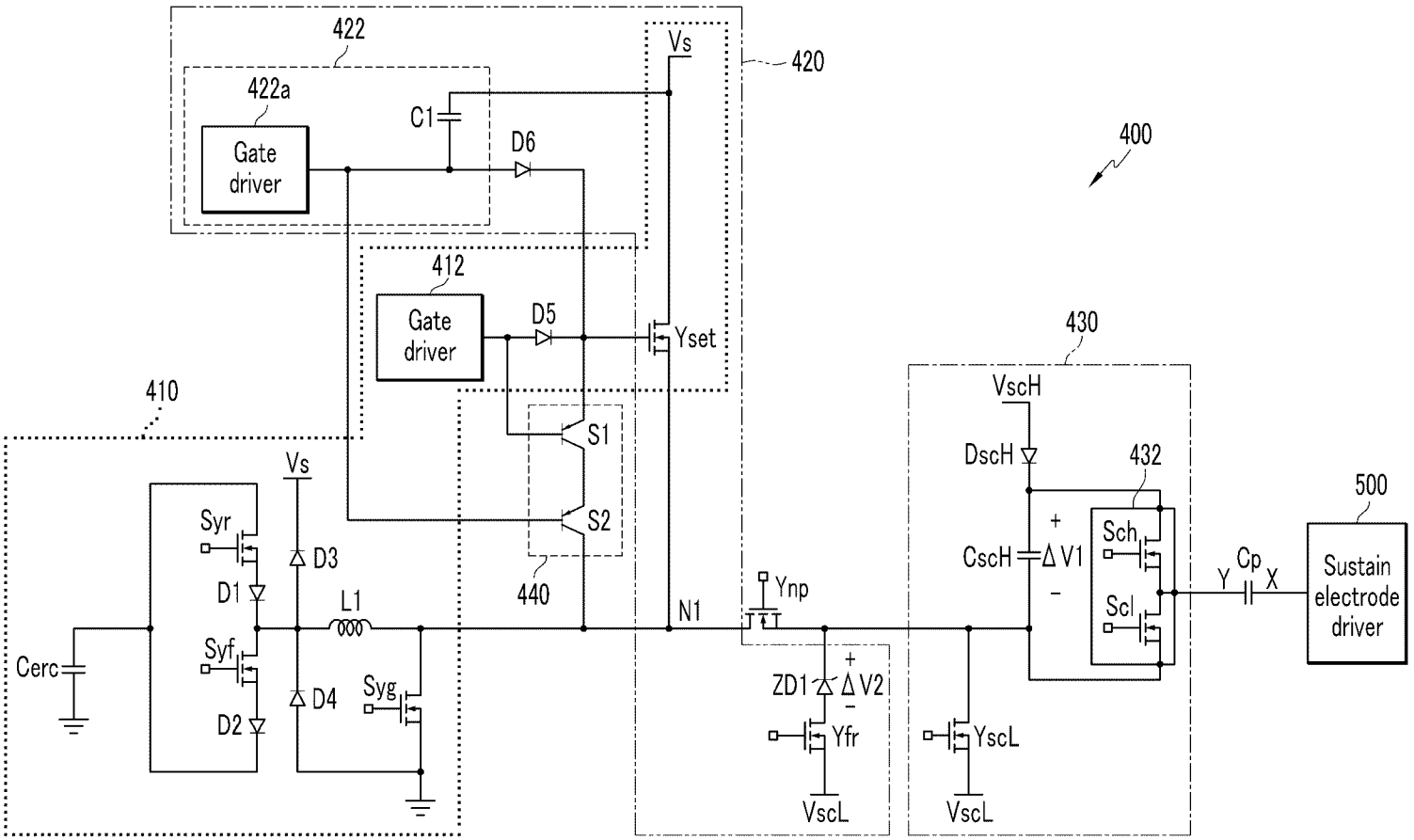
FIG. 3 is a circuit diagram of a scan electrode driver according to an embodiment.

FIG. 3 is a circuit diagram of a scan electrode driver 400 according to one embodiment.

The scan electrode driver 400 includes a plurality of driving circuits for realizing the driving waveform of FIG. 2, but only a portion of the driving circuits is illustrated in FIG. 3. In addition, although some of the switches are illustrated as an N-channel field effect transistor (FET) having a drain and a source as two main terminals, and a gate as a control terminal in FIG. 3, another switch that performs a function that is similar to or the same as that of the FET can also be used as the transistor. In addition, any of the switches may have a body diode (not shown) having an anode coupled to the source and a cathode coupled to the drain. Further, a capacitive component formed by the sustain electrode X and the scan electrode Y is illustrated as a panel capacitor Cp in FIG. 3.

Referring to FIG. 3, the scan electrode driver 400 includes a sustain driver 410, a reset driver 420, a scan driver 430, a switch turn-off unit 440, and a path switch Ynp.

The scan driver 430 includes a switch YscL, a capacitor CscH, a diode DscH, and a scan circuit 432.

An anode of the diode DscH is coupled to a power source VscH supplying a voltage of VscH, and a cathode thereof is coupled to one terminal of the capacitor CscH. A drain of the switch YscL is coupled to the other terminal of the capacitor CscH, and a source of the switch YscL is coupled to a power source VscL for supplying a voltage of VscL. The capacitor CscH may be charged to the voltage of ΔV1 shown in FIG. 2 (e.g., a voltage difference of VscH and VscL) when the switch YscL is turned on.

A plurality of scan circuits 432 that correspond to the plurality of Y electrodes $Y_1$ to $Y_n$ are formed, but one scan circuit 432 corresponding to one Y electrode is illustrated in FIG. 3. In addition, a number of scan circuits 432 may be formed as one integrated circuit (IC). The scan circuit 432 has two input terminals and an output terminal and includes a switch Sch and a switch Sc1.

A drain of the switch Sch is coupled to one input terminal of the scan circuit 432, which is coupled to one terminal of the capacitor CscH. A source of the switch of the switch Sc1 is coupled to another input terminal of the scan circuit 432, which is coupled to the other terminal of the capacitor CscH and the drain of the switch YscL. A source of the switch Sch and a drain of the switch Sc1 are coupled to the output terminal of the scan circuit 432, and the output terminal is coupled to the corresponding scan electrode Y.

During the address period, the scan circuit 432 outputs the voltage of VscL when the corresponding scan electrode Y is selected in the address period, and outputs the voltage of VscH when the corresponding scan electrode Y is not selected.

The path switch Ynp is coupled between a node N1 and an input terminal of the scan circuit 432. The path switch Ynp remains on during the sustain period and the rising period of the reset period, and thereby, the voltage of the node N1 is supplied to the scan electrode Y through the path switch Ynp.

The sustain driver 410 includes switches Syg and Yset, a diode D5, and a gate driver 412.

The gate driver 412 has an output terminal, and outputs a sustain control signal to the output terminal. The sustain control signal may have a high level during a period in which the voltage of Vs is applied to the scan electrode Y, and have a low level during a period in which the voltage of Vs is not applied to the scan electrode Y.

A drain of the switch Yset is coupled to a power source Vs for supplying the voltage of Vs, and a source of the switch Yset is coupled to the node N1. The diode D5 has a cathode coupled to a gate of the switch Yset and an anode coupled to the output terminal of the gate driver 412. The gate driver 412 applies the sustain control signal having the high level to the gate of the switch Yset via the diode D5 to turn on the switch Yset in a portion of a sustain period. Then, the switch Yset is turned on to transmit the voltage of Vs to the scan electrode Y via the switch Ynp and the switch Sc1 of the scan circuit 432.

A drain of the switch Syg is coupled to the node N1, and a source of the switch Syg is coupled to a power source for supplying the low level voltage, i.e., a ground terminal. The switch Syg is turned on to transmit the reference voltage to the scan electrode Y via the path switch Ynp and the switch Sc1 of the scan circuit 432.

The sustain driver 410 may further include an energy recovery unit. Referring to FIG. 3, one example of the energy recovery unit includes an inductor L1, switches Syr and Syf, diodes D1 and D2, and a capacitor Cerc.

The inductor L1 has one terminal coupled to the node N1. A drain of the switch Syf and a cathode of the diode D1 are coupled to the other terminal of the inductor L1. A source of the switch Syf is coupled to an anode of the diode D2, and an anode of the diode D1 is coupled to a source of the switch Syr. A cathode of the diode D2 and a drain of the switch Syr are coupled to one terminal of the capacitor Cerc, and another terminal of the capacitor Cerc is coupled to the ground terminal.

In addition, the sustain driver 410 may further include diodes D3 and D4. The diode D3 has an anode coupled to the inductor L1 and a cathode coupled to the power source Vs, and clamps a voltage of the terminal of the inductor L1 to the voltage of Vs. The diode D4 has an anode coupled to the ground terminal and a cathode coupled to another terminal of the inductor L1, and clamps the voltage of the terminal of the inductor L1 to the reference voltage.

The reset driver 420 includes a switch Yfr, a zener diode ZD1, a diode D6, and a reset controller 422, and shares the switch Yset with the sustain driver 410.

The reset controller 422 has an output terminal, and outputs a reset control signal to the output terminal. The reset control signal may have a high level during a rising period of a reset period, and have a low level otherwise. The diode D6 has an anode coupled to the output terminal of the reset controller 422 and a cathode coupled to the gate of the switch Yset. The reset controller 422 controls the switch Yset via the diode D6 so that the voltage of the scan electrode Y is gradually increased. This example of the reset controller 422 includes a gate driver 422*a* and a capacitor C1. The gate driver 422*a* has an output terminal coupled to the output terminal of the reset controller 422, and outputs the reset control signal.

One terminal of the capacitor C1 is coupled to the output terminal of the gate driver 422*a*, i.e., the gate of the switch Yset, and another terminal of the capacitor C1 is coupled to the drain of the switch Yset, i.e., the power source Vs. In addition, a resistor (not shown) may be coupled to the capacitor C1 in series between the gate and the drain of the switch Yset. While the reset control signal has the high level, the switch Yset is operated to transmit a current, which has substantially constant magnitude, by the capacitor C1. Then, the voltage of the scan electrode Y can be gradually increased in a ramp pattern.

A cathode of the zener diode ZD1 is coupled to a source of the path switch Ynp. A drain of the switch Yfr is coupled to an anode of the zener diode ZD1, and a source of the switch Yfr is coupled to a power source VscL for supplying the voltage of VscL. That is, the zener diode ZD1 and the switch Yfr are coupled in series between the source of the path switch Ynp and the power source VscL. The serial connection order of the zener diode ZD1 and the switch YscL may be reversed in some embodiments.

The breakdown voltage of the zener diode ZD1 is equal to the voltage of ΔV2 shown in FIG. 2, i.e., the difference between the voltage of VscL and the voltage of Vnf.

The diode D5 of the sustain driver 410 prevents the reset control signal of the gate driver 422*a* from inflowing to the gate driver 412, and the diode D6 of the reset driver 420 likewise prevents the sustain control signal of the gate driver 412 from inflowing to the gate driver 422*a*.

However, the sustain control signal having the low level from the gate driver 412 may be not applied to the gate of the switch Yset by the diode D5, and the reset control signal having the low level from the gate driver 422*a* may be not applied to the gate of the switch Yset by the diode D6. As a result, the switch Yset may be not turned off. Accordingly, the switch turn-off unit 440 turns off the switch Yset if both the sustain control signal and the reset control signal have the low level.

The switch turn-off unit 440 includes two switches S1 and S2 as shown in FIG. 3. Although the switches S1 and S2 are illustrated as p-type bipolar junction transistors (BJTs), each having a collector and an emitter as two main terminal, and a base as a control terminal in FIG. 3, another switch that performs a function that is similar to or the same as that of the p-type BJT can also be used as either of the switches S1 and S2.

A base of the switch S1 and a base of the switch S2 are coupled to output terminals of the gate drivers 412 and 422*a*, respectively. An emitter of the switch S1 is coupled to the gate of the switch Yset, a collector of the switch S1 is coupled to an emitter of the switch S2, and a collector of the switch S2 is coupled to the source of the switch Yset, i.e., the node N1. That is, the switches S1 and S2 are coupled in series between the gate and the source of the switch Yset. In this case, the serial connection order of the switches S1 and S2 may be reversed in some embodiments. The switch S1 is turned on in response to the low level of the sustain control signal, and the switch S2 is turned on in response to the low level of the reset control signal. Accordingly, the switch turn-off unit 440 sets a voltage between the gate and the source of the switch Yset to 0V when both the switches S1 and S2 are turned on. As a result, the switch Yset is turned off.

As described above, according to the embodiment, the sustain driver 410 and the reset driver 420 of the scan electrode driver 400 use the switch Yset in common to increase the voltage of the scan electrode Y from the voltage of ΔV1 voltage to voltage of (ΔV1+Vs) in the reset period and to apply the voltage of Vs to the scan electrode Y in the sustain period. Therefore, in comparison with a conventional plasma display device that uses separate switches in the sustain driver and the reset driver, a production cost is reduced and a circuit design is simplified.

Hereinafter, an operation of a plasma display device according to an embodiment will be described with reference to FIG. 4, FIG. 5, FIG. 6, and FIG. 7.

Figure 4:
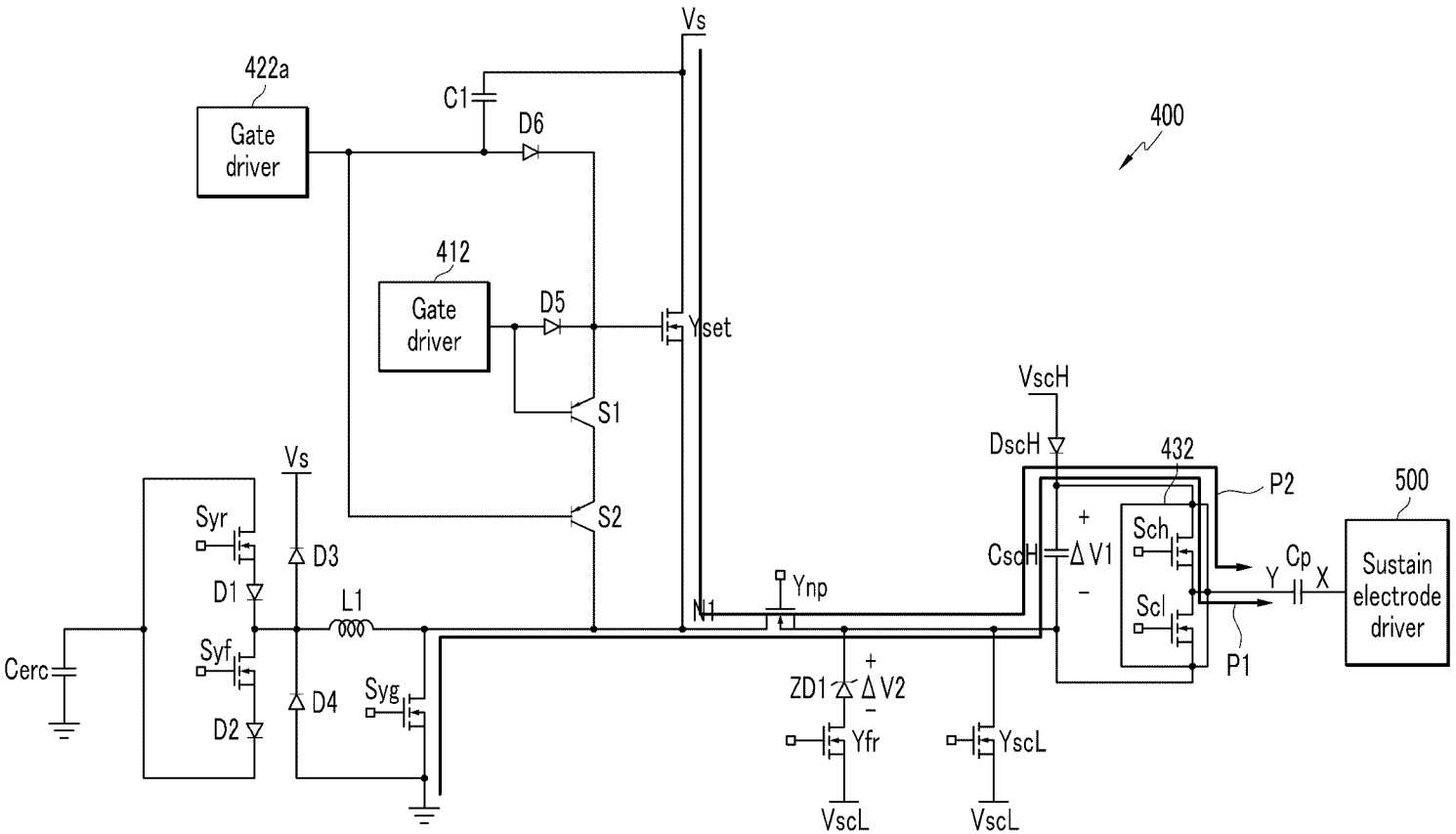
FIG. 4 shows an operation of a plasma display device according to an embodiment in a rising period of a reset period.
Figure 5:
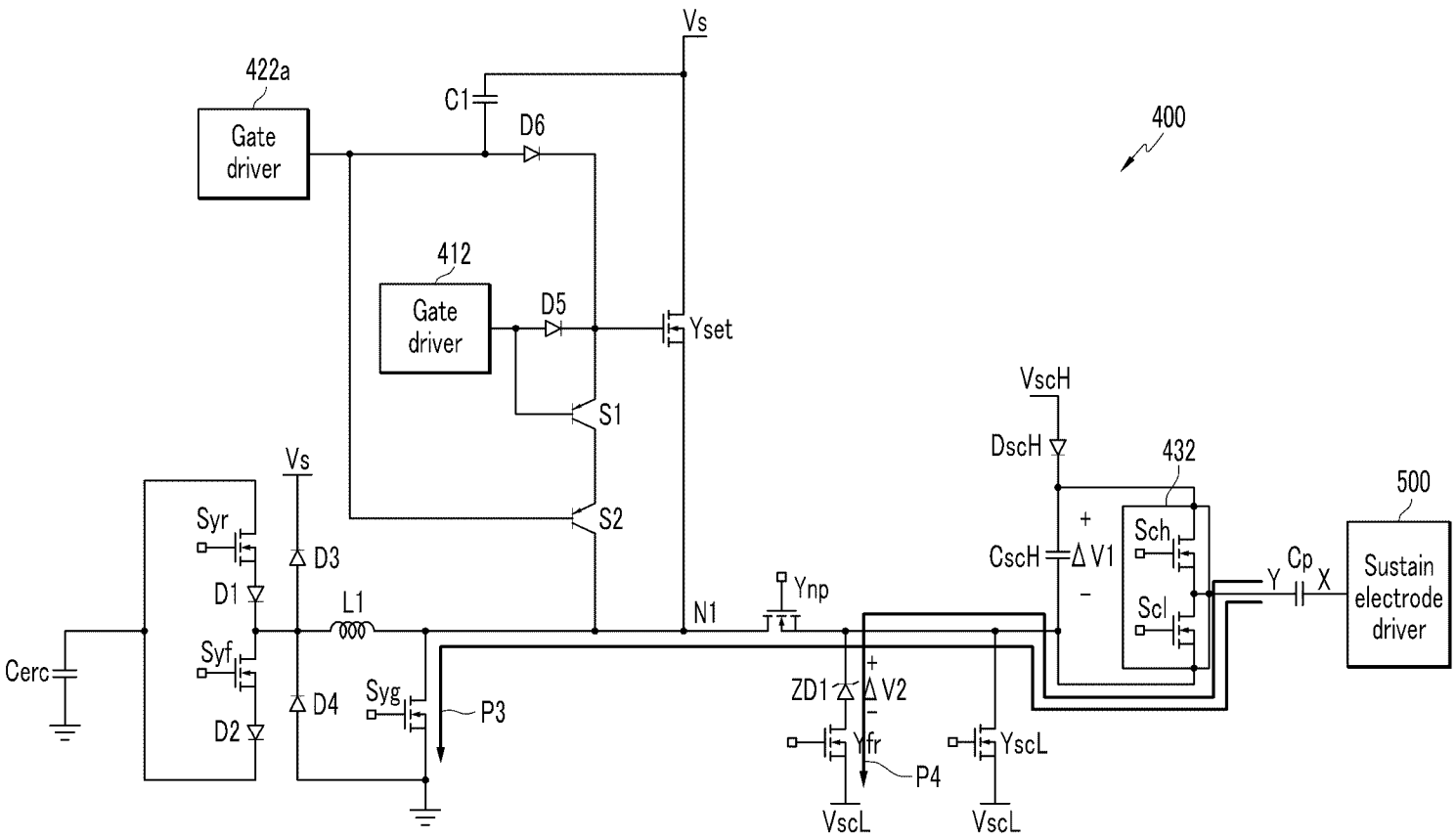
FIG. 5 shows an operation of a plasma display device according to an embodiment in a falling period of the reset period.
Figure 6:
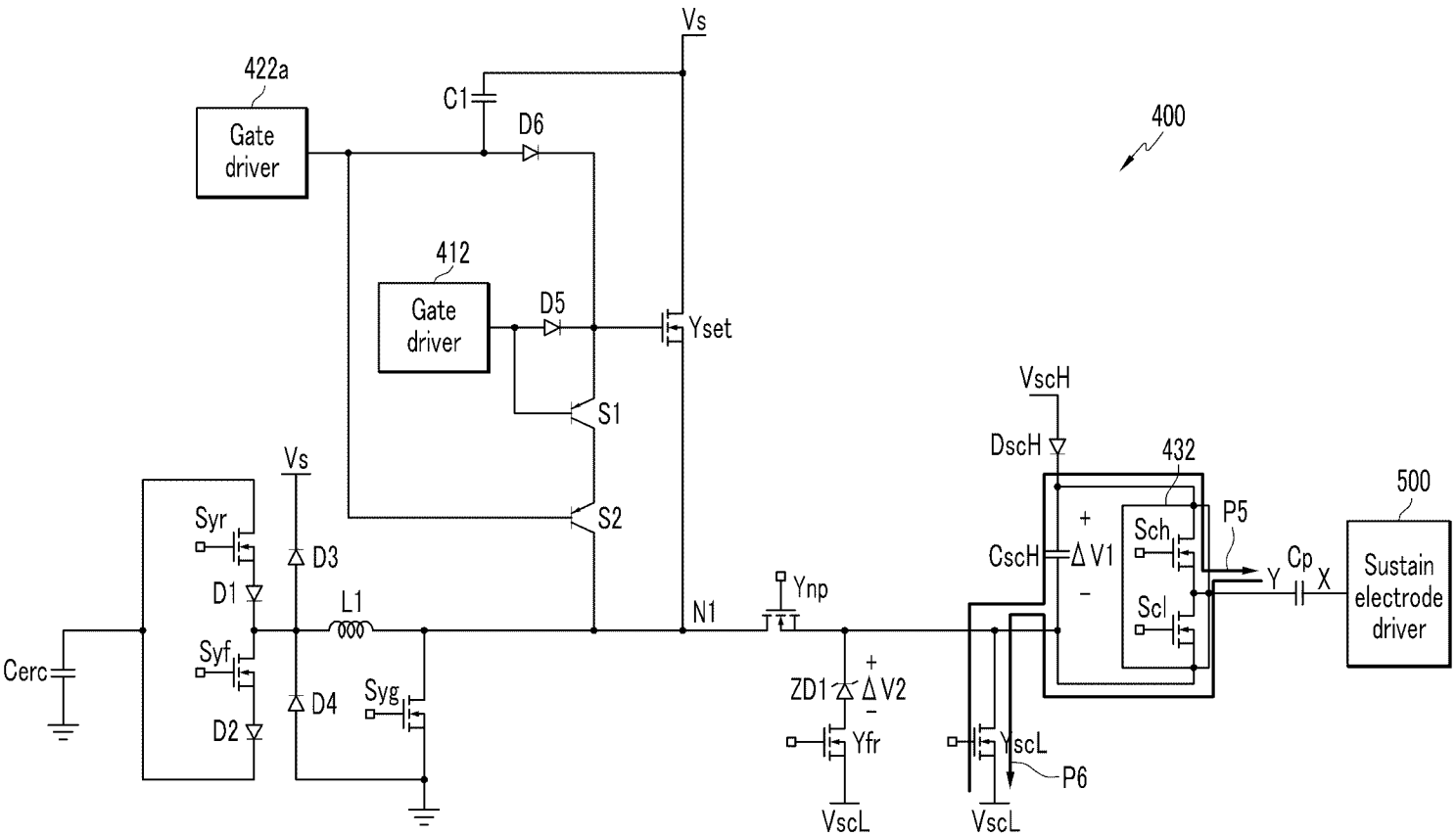
FIG. 6 shows an operation of a plasma display device according to an embodiment in an address period.
Figure 7:
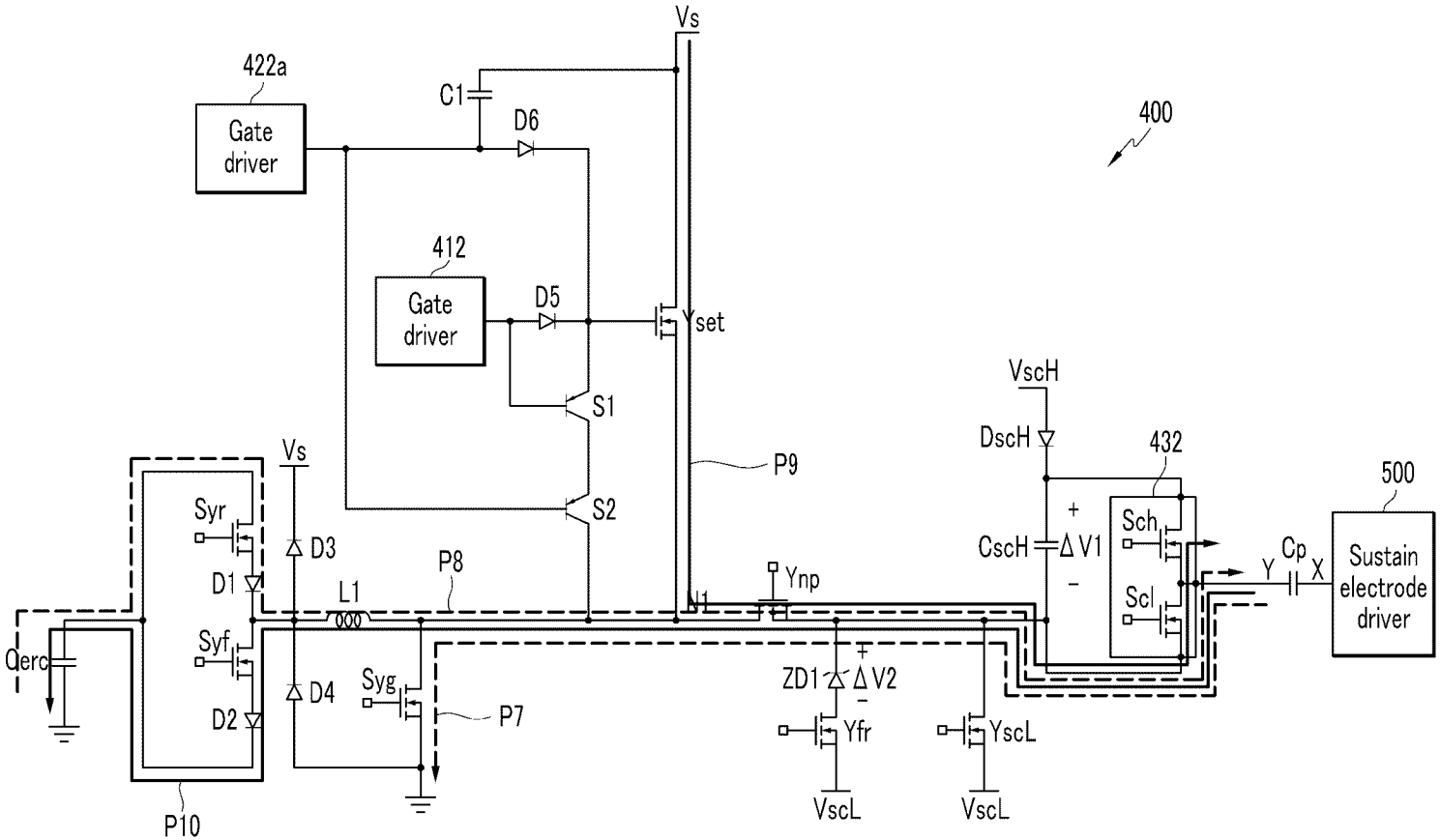
FIG. 7 shows an operation of a plasma display device according to an embodiment in a sustain period.

FIG. 4 shows an operation of a plasma display device according to one embodiment in a rising period of a reset period, FIG. 5 shows an operation of a plasma display device according to one embodiment in a falling period of the reset period, FIG. 6 shows an operation of a plasma display device according to one embodiment in an address period, and FIG. 7 shows an operation of a plasma display device according to one embodiment in a sustain period.

The switches Sch, YscL, Yfr, Syr, Syf, and Yset are turned off and the switch Syg, S1, S2, Ynp and Sc1 are turned on such that the reference voltage is applied to the scan electrode Y before a reset period. In this case, the switch Yset is turned off by the switches S1 and S2 that are turned on by the sustain control signal having the low level and the reset control signal having the low level from the gate drivers 412 and 422*a*.

First, during a rising period of the reset period, the switch Sc1 is turned off and the switch Sch is turned on while the switches Syg and Ynp are on. Then, as shown in FIG. 4, a current path P1 including the ground terminal, the switches Syg and Ynp, the capacitor CscH, the switch Sch, and the scan electrode Y is formed. The voltage ΔV1 charged to the capacitor CscH, which is the difference of the voltage of VscH and the voltage of VscL, is applied to the scan electrode Y through the current path P1 such that the voltage of the scan electrode Y is increased to the voltage of ΔV1 voltage from the reference voltage.

Subsequently, the switch Syg is turned off, and the switch Yset is turned on. In this reset case, the switch Yset is turned on in response to the reset control signal having the high level from the gate driver 422*a*. In addition, the switch S2 is turned off by the reset control signal having the high level. Then, a current path P2 including the power source Vs, the switches Yset and Ynp, the capacitor CscH, the switch Sch, and the scan electrode Y is formed as shown in FIG. 4. In addition, the switch Yset is operated to transmit a current, which has a substantially constant magnitude, through the current path P2 by the capacitor C1. As a result, the voltage of the scan electrode Y is gradually increased from the voltage of ΔV1 to the voltage of (ΔV1+Vs) in a ramp pattern.

Next, in a falling period of the reset period, the switches Yset and Sch are turned off and the switches Syg and Sc1 are turned on while the switch Ynp is on. Accordingly, a current path P3, as shown in FIG. 5, including the scan electrode Y, the switches Sc1, Ynp, and Syg, and the ground terminal is formed such that the reference voltage is applied to the scan electrode Y.

Subsequently, the switches Syg and Ynp are turned off and the switch Yfr is turned on such that a current path P4 including the scan electrode Y, the switch Sc1, the zener diode ZD1, the switch Yfr, and the power source VscL, as shown in FIG. 5. The voltage of the scan electrode Y is gradually decreased to the voltage of Vnf through the current path P4. In this case, the switch Yfr is operated to transmit a current, which has a substantially constant magnitude, through the current path P4. In addition, the switch Ynp (in the off state) blocks a current path, including the ground terminal, the switch Syg, the switch Ynp, the zener diode ZD1, the switch Yfr, and the power source VscL, that may be formed by the body diode of the switch Syg.

During the falling period, the gate drivers 412 and 422*a* output the signals having the low level such that the switches S1 and S2 are turned on. Accordingly, a gate voltage of the switch Yset is equal to a source voltage of the switch Yset such that the switch Yset is turned off.

Referring to FIG. 6, during the address period, the switches Yfr and Sc1 are turned off and the switches YscL and Sch are turned on such that current path P5 including and the power source VscL, the switch YscL, the capacitor CscH, the switch Sch, and the scan electrode Y are formed. The voltage of VscH is applied to the scan electrode Y through the current path P5.

When the scan electrode Y is selected during the address period, the switch Sch is turned off and the switch Sc1 is turned on. As a result, a current path P6 including the scan electrode Y, the switches Sc1 and YscL, and the power source VscL, is formed such that the voltage of VscL is applied to the scan electrode Y. Subsequently, the switch Sc1 is turned off, and the switch Sch is turned on such that the voltage of VscH is applied to the scan electrode Y again.

Referring to FIG. 7, during the sustain period, the switches Sch and YscL are turned off and the switches Sc1, Ynp, and Syg are turned on such that the reference voltage is applied to the scan electrode Y through a current path P7 including the scan electrode Y, the switches Sc1, Ynp, Syg, and the ground terminal.

Subsequently, the switch Syg is turned off and the switch Syr is turned on such that a current path P8 including the ground terminal, the capacitor Cerc, the switch Syr, the diode D1, the inductor L1, the switches Ynp and Sc1, and the scan electrode Y is formed. A resonance between the inductor L1 and the panel capacitor Cp occurs in the current path P8 such that the voltage of the scan electrode Y is increased.

When the voltage of the scan electrode Y almost or substantially reaches the voltage of Vs, the switch Yset is turned on and the switch Syr is turned off. As a result, the voltage of Vs is applied to the scan electrode through a current path P9 including the power source Vs, the switches Yset, Ynp, and Sc1, and the scan electrode Y.

In this sustain case, the switch Yset is turned on in response to the sustain control signal having the high level from the gate driver 412. In addition, the switch S1 is turned off by the sustain control signal having the high level.

Next, the switch Yset is turned off and the switch Syf is turned on such that a current path P10 including the scan electrode Y, the switches Sc1 and Ynp, the inductor L1, the switch Syf, the diode D2, the capacitor Cerc, and the ground terminal is formed. A resonance between the inductor L1 and the panel capacitor Cp occurs in the current path P10 such that the voltage of the scan electrode Y is decreased.

The sustain control signal from the gate driver 412 is changed to the low level, and the reset control from the gate driver 422*a* is maintained at the low level. As a result, the switches S1 and S2 are both turned on such that the switch Yset is turned off.

When the voltage of the scan electrode Y almost or substantially reaches the reference voltage, the switch Syg is turned on, and the switch Yset is turned off such that the reference voltage is applied to the scan electrode through the current path P7.

During the sustain period, the voltage of Vs and the reference voltage are alternately applied to the scan electrode Y by repeating the above operations.

Figure 8:
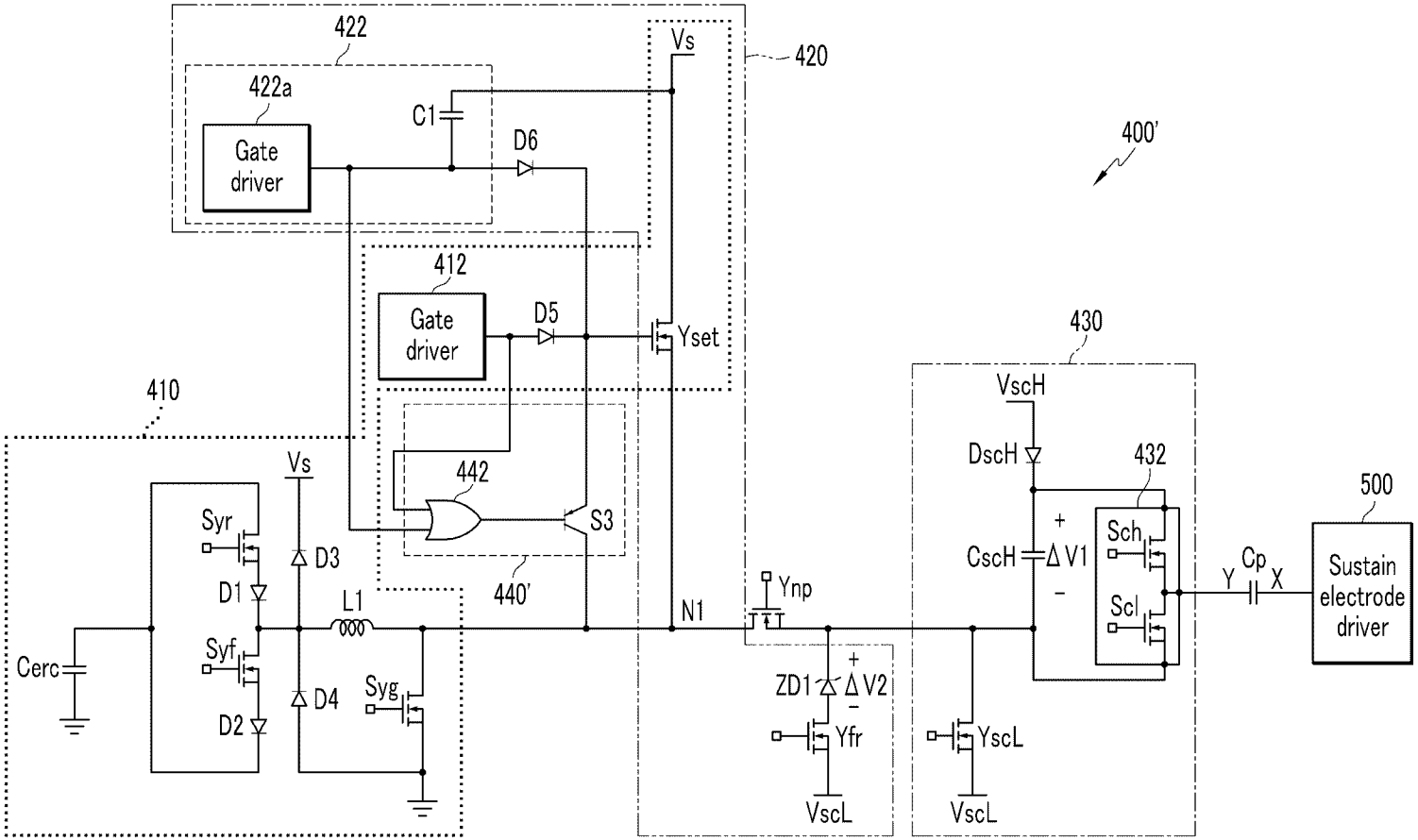
FIG. 8 is a circuit diagram of a scan electrode driver according to another embodiment.

FIG. 8 is a circuit diagram of a scan electrode driver according to another embodiment.

Referring to FIG. 8, a scan electrode driver 400' may include a switch turn-off unit 440' including a switch S3 and a logic gate, for example an OR gate 442, instead of the switch turn-off unit 440 shown in FIG. 3.

The OR gate 442 has two input terminals and an output terminal, and the two input terminals are coupled to the output terminals of the gate drivers 412 and 422*a*, respectively. The switch S3 has a base coupled to the output terminal of the OR gate 442, an emitter coupled to the gate of the switch Yset, and a collector coupled to a source of the switch Yset, i.e., the node N1.

The OR gate 442 outputs a signal having the low level when the outputs of the two gate drivers 412 and 422*a* are the low level. When the output of the OR gate 442 is the low level, the switch S3 is turned on such that the switch Yset is turned off. In addition, the OR gate 442 outputs the signal having the high level when any one of the outputs of the two gate drivers 412 and 422*a* is the high level. When the output of the OR gate 442 is the high level, the switch S3 is turned off, and the switch Yset is turned on in response to the high level output of the gate driver 412 or 422*a*.

Figure 9:
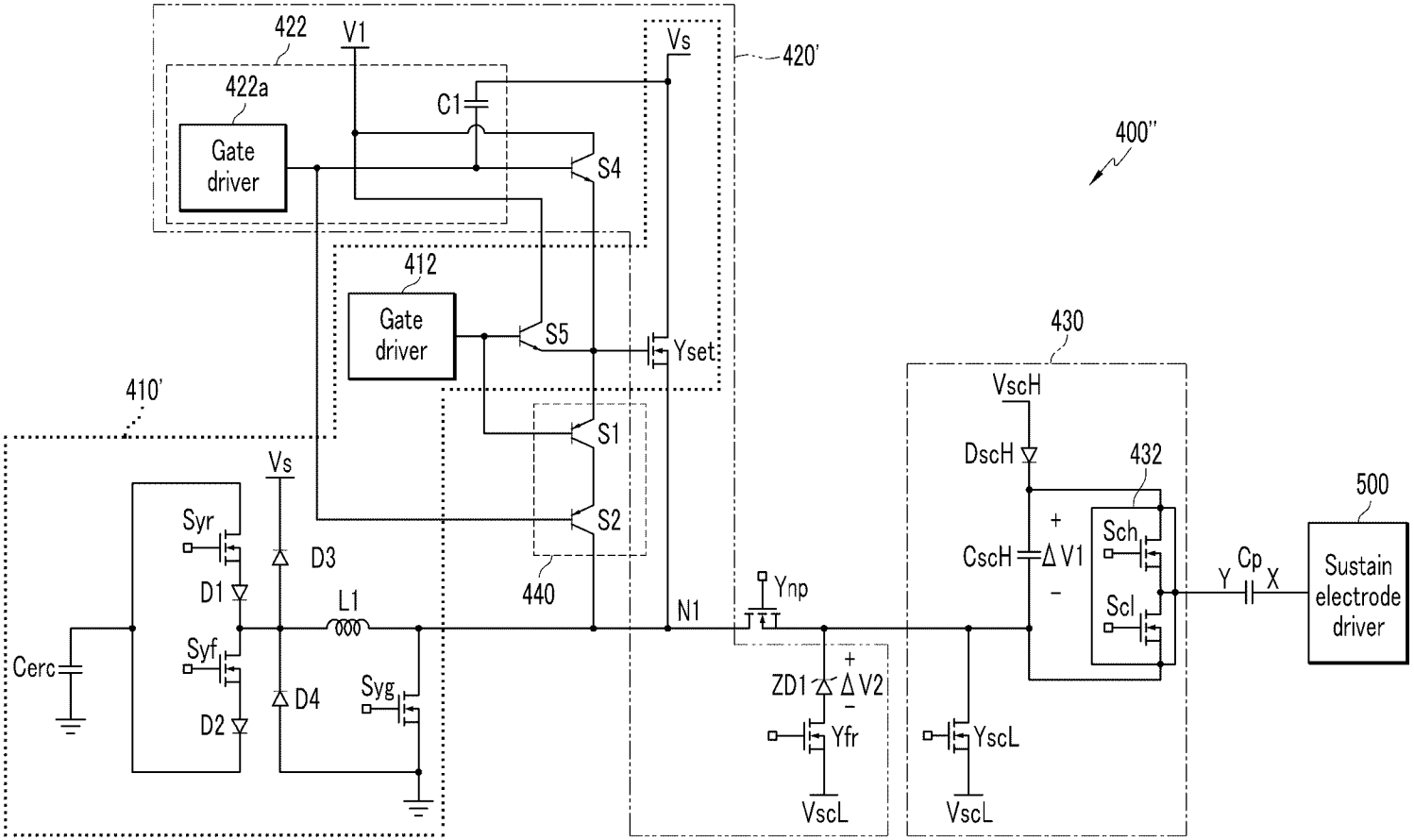
FIG. 9 is a circuit diagram of a scan electrode driver according to yet another embodiment.

FIG. 9 is a circuit diagram of a scan electrode driver according to yet another embodiment.

Referring to FIG. 9, a scan electrode driver 400" may include switches S4 and S5 instead of the diodes D5 and D6 shown in FIG. 3.

The switch S4 is included in a reset driver 420', and has a base coupled to the output terminal of the gate driver 422*a*, a collector coupled to a power source V1 supplying a voltage of V1, and an emitter coupled to the gate of the switch Yset. The switch S5 is included in a sustain driver 410', and has a base coupled to the output terminal of the gate driver 412, a collector coupled to the power source V1, and an emitter coupled to the gate of the switch Yset. Although the switches S4 and S5 are illustrated as n-type BJTs, each having a collector and an emitter as two main terminals, and a base as a control terminal in FIG. 9, another switch that performs a function that is similar to or the same as that of the n-type BJT can also be used as either of the switches S4 and S5.

The switch S4 is turned on in response to the reset control signal having the high level from the gate driver 422*a*. The switch S4 in an on state transmits the voltage of V1 from the power source V1 to the gate of the switch Yset such that the switch Yset is turned on. The switch S5 is turned on in response to the sustain control signal having the high level from the gate driver 412. The switch S5 in an on state transmits the voltage of V1 from the power source V1 to the gate of the switch Yset such that the switch Yset is turned on.

In addition, the switch S4 can prevent the sustain control signal of the gate driver 410 from inflowing to the gate driver 422*a*, and the switch S5 can prevent the reset control signal of the gate driver 422*a* from inflowing to the gate driver 412.

As described above, the scan electrode driver 400, 400', or 400" according to the embodiments can use the switch Yset in common to both gradually increase the voltage of the scan electrode Y in the reset period and to apply the voltage of Vs to the scan electrode Y in the sustain period. Therefore, production costs are reduced, and a driving circuit of the plasma display device is simplified. In addition, the gate driver 412 or 422*a* can be prevented from receiving an output signal of another gate driver 422*a* or 412.

While the embodiments been described in connection with what is presently considered to be practical, it is to be understood that the invention is not limited to the disclosed embodiments, but, on the contrary, is intended to cover various modifications and equivalent arrangements.

What is claimed is:

1. A plasma display device comprising:

a display electrode;

a first switch that includes a first terminal coupled to a node, a second terminal coupled to a power source supplying a first voltage, and a control terminal, the node being coupled to the display electrode;

a first gate driver that includes an output terminal, the first gate driver configured to output a first control signal having a first level to the control terminal of the first switch through the output terminal of the first gate driver, the first switch configured to gradually increase a voltage of the display electrode from a second voltage to a third voltage in response to the first control signal having the first level;

a second gate driver that includes an output terminal, the second gate driver configured to output a second control signal having the first level to the control terminal of the first switch through output terminal of the second gate driver, the first switch configured to transmit the first voltage from the power source to the display electrode in response to the second control signal having the first level; and a switch turn-off unit configured to turn off the first switch in response to the first control signal having a second level and the second control signal having the second level, the second level being different from the first level.

2. The plasma display device of claim 1, further comprising a diode that includes an anode coupled to the output terminal of the first gate driver and a cathode coupled to the control terminal of the first switch.

3. The plasma display device of claim 1, further comprising a diode that includes an anode coupled to the output terminal of the second gate driver and a cathode coupled to the control terminal of the first switch.

4. The plasma display device of claim 1, further comprising a second switch, the second switch comprising:

a first terminal coupled to another power source supplying a fourth voltage;

a second terminal coupled to the control terminal of the first switch, and a control terminal coupled to the output terminal of the first gate driver, wherein the second switch is turned on in response to the first control signal having the first level to transmit the fourth voltage to the control terminal of the first switch.

5. The plasma display device of claim 1, further comprising a second switch, the second switch comprising:

a first terminal coupled to another power source supplying a fourth voltage;

a second terminal coupled to the control terminal of the first switch, and a control terminal coupled to the output terminal of the second gate driver, wherein the second switch is turned on in response to the second control signal having the first level to transmit the fourth voltage to the control terminal of the first switch.

6. The plasma display device of claim 1, further comprising a capacitor coupled between the second terminal of the first switch and the control terminal of the first switch.

7. The plasma display device of claim 1, wherein a frame comprises a subfield including a reset period, an address period, and a sustain period, and the first gate driver is configured to output the first control signal having the first level in a portion of the reset period, and the second gate driver is configured to output the second control signal having the first level in a portion of the sustain period.

8. The plasma display device of claim 7, wherein the third voltage is a sum of the first voltage and the second voltage.

9. The plasma display device of claim 7, further comprising:

a scan circuit, comprising:

an output terminal coupled to the display electrode;

a first input terminal coupled to the node;

a second input terminal; and a capacitor coupled between the first input terminal of the scan circuit and the second input terminal of the scan circuit, wherein the voltage of the display electrode is gradually increased through a first path including the power source, the first switch, the node, the capacitor, the second input terminal of the scan circuit, the output terminal of the scan circuit, and the display electrode, and wherein the first voltage is applied to the display electrode through a second path including the power source, the first switch, the node, the first input terminal of the scan circuit, the output terminal of the scan circuit, and the display electrode.

10. The plasma display device of claim 9, further comprising a third switch coupled between the node and the first input terminal of the scan circuit.

11. The plasma display device of claim 10, wherein the capacitor is configured to be charged to the second voltage.

12. The plasma display device of claim 1, wherein the switch turn-off unit comprises a second switch and a third switch coupled in series between the control terminal of the first switch and the first terminal of the first switch, wherein the second switch is turned on in response to the first control signal having the second level, and the third switch is turned on in response to the second control signal having the second level.

13. The plasma display device of claim 1, wherein the switch turn-off unit comprises:

a logic gate that includes a first input terminal configured to receive the first control signal, a second input terminal configured to receive the second control signal, and an output terminal configured to output an output signal having a third level when the first control signal has the second level and the second control signal has the second level; and a second switch that is coupled between the control terminal of the first switch and the first terminal of the first switch, and is turned on in response to the output signal having the third level.

14. The plasma display device of claim 13, wherein the logic gate is an OR gate.

15. A method of driving a plasma display device including a display electrode and a switch coupled between the display electrode and a power source supplying a first voltage, the method comprising:

dividing a subfield into at least a reset period, an address period, and a sustain period;

outputting a first control signal having a first level and a second control signal having a second level being different from the first level in a portion of the reset period;

operating the switch to gradually increase a voltage of the display electrode from a second voltage to a third voltage in response to the first control signal having the first level;

outputting the first control signal having the second level and the second control signal having the second level in the address period;

turning off the switch in response to the first control signal having the second level and the second control signal having the second level;

outputting the first control signal having the second level and the second control signal having the first level in a portion of the sustain period; and operating the switch to transmit the first voltage from the power source to the display electrode in response to the second control signal having the first level.

16. The method of claim 15, wherein the switch includes a first terminal coupled to the display electrode;

a second terminal coupled to the power source; and a control terminal, wherein turning off the switch comprises coupling the first terminal and the control terminal of the switch in response to the first control signal having the second level and the second control signal having the second level.

17. The method of claim 16, wherein coupling the first terminal and the control terminal of the switch comprises setting a voltage of the control terminal of the first switch to be substantially equal to a voltage of the first terminal of the first switch.

18. An apparatus for driving a plasma display device including a display electrode, the apparatus comprising:

a switch coupled between the display electrode and a power source configured to supply a first voltage;

a first gate driver that outputs a first control signal alternately having a first level and a second level;

a second gate driver that outputs a second control signal alternately having the first level and the second level;

a switch turn-off unit that turns off the switch in response to the first control signal having the second level and the second control signal having the second level, wherein the switch is configured to gradually increase a voltage of the display electrode from a second voltage to a third voltage in response to the first control signal having the first level, and the switch is configured to transmit the first voltage from the power source to the display electrode in response to the second control signal having the first level.

19. The apparatus of claim 18, wherein the switch includes:

a first terminal coupled to the display electrode, a second terminal coupled to the power source, and a control terminal, wherein the switch turn-off unit is configured to turn off the switch by coupling the first terminal and the control terminal of the switch in response to the first control signal having the second level and the second control signal having the second level.

20. The apparatus of claim 19, wherein the switch turn-off unit sets a voltage of a gate of the first switch to be substantially equal to a voltage of a source of the first switch by coupling the first terminal and the control terminal of the switch.

* * * * *